US011136849B2

(12) United States Patent
Al-Mousa et al.

(10) Patent No.: US 11,136,849 B2
(45) Date of Patent: Oct. 5, 2021

(54) DUAL STRING FLUID MANAGEMENT DEVICES FOR OIL AND GAS APPLICATIONS

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 118 days.

(21) Appl. No.: 16/674,383

(22) Filed: Nov. 5, 2019

(65) Prior Publication Data

US 2021/0131215 A1 May 6, 2021

(51) Int. Cl.
*E21B 33/10* (2006.01)
*E21B 33/06* (2006.01)

(52) U.S. Cl.
CPC ..... *E21B 33/10* (2013.01); *E21B 33/06* (2013.01)

(58) Field of Classification Search
CPC ..... E21B 33/10; E21B 33/06
See application file for complete search history.

(56) References Cited

U.S. PATENT DOCUMENTS 880,404 A 2/1908 Sanford
1,591,264 A 7/1926 Baash
1,789,993 A 1/1931 Switzer
1,896,482 A 2/1933 Crowell
1,949,498 A 3/1934 Frederick et al.
2,121,002 A 6/1938 Baker
2,121,051 A 6/1938 Ragan et al.
(Continued)

FOREIGN PATENT DOCUMENTS

AU 636642 5/1993
AU 2007249417 11/2007
(Continued)

OTHER PUBLICATIONS

Bruton et al., "Whipstock Options for Sidetracking," Oilfield Review, vol. 26, No. 1, Spring 2014, 10 pages.
(Continued)

*Primary Examiner* — Cathleen R Hutchins
*Assistant Examiner* — Jonathan Malikasim
(74) *Attorney, Agent, or Firm* — Fish & Richardson P.C.

(57) ABSTRACT

A fluid management device includes a seal and a piston coupled to the seal and movable to an activated position to adjust the seal to an activated state. The seal includes first sealing elements extending radially inward towards a central axis of the fluid management device and second sealing elements extending radially inward towards the central axis, the first and second sealing elements together defining an opening sized to surround first and second pipes disposed within a wellbore containing wellbore fluid. In the activated state, the first sealing elements contact each other within the opening between the first and second pipes and seal against a first inner portion of the first pipe and a second inner portion of the second pipe to close the opening between the first and second pipes and a closed state of the opening prevents the wellbore fluid from exiting the wellbore through the opening.

14 Claims, 4 Drawing Sheets

(56) References Cited

U.S. PATENT DOCUMENTS 2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,411,260 A 11/1946 Glover et al.
2,546,978 A 4/1951 Collins et al.
2,672,199 A 3/1954 McKenna
2,707,998 A 5/1955 Baker et al.
2,728,599 A 12/1955 Moore
2,751,010 A 6/1956 Trahan
2,881,838 A 4/1959 Morse et al.
2,912,053 A 11/1959 Bruekelman
2,912,273 A 11/1959 Chadderdon et al.
2,915,127 A 12/1959 Abendroth
2,965,175 A 12/1960 Ransom
2,965,177 A 12/1960 Le Bus et al.
3,116,799 A 1/1964 Lemons
3,147,536 A 9/1964 Lamphere
3,225,828 A 12/1965 Wisenbaker et al.
3,369,603 A 2/1968 Trentham
3,381,748 A 5/1968 Peters et al.
3,382,925 A 5/1968 Jennings
3,409,084 A 11/1968 Lawson, Jr. et al.
3,554,278 A * 1/1971 Reistle, III ..... E21B 17/1007 166/85.1
3,667,721 A 6/1972 Vujasinovic
3,897,038 A 7/1975 Le Rouax
3,915,426 A 10/1975 Le Rouax
3,955,622 A * 5/1976 Jones ..... E21B 17/1007 166/352
4,030,354 A 6/1977 Scott
4,042,019 A 8/1977 Henning
4,059,155 A 11/1977 Greer
4,099,699 A 7/1978 Allen
4,190,112 A 2/1980 Davis
4,215,747 A * 8/1980 Cox ..... E21B 33/047 166/85.5
4,254,983 A 3/1981 Harris
4,276,931 A 7/1981 Murray
4,296,822 A 10/1981 Ormsby
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,538,684 A 9/1985 Sheffield
4,562,888 A 1/1986 Collet
4,696,502 A 9/1987 Desai
4,834,184 A 5/1989 Streich et al.
4,869,321 A 9/1989 Hamilton
4,898,245 A 2/1990 Braddick
4,953,617 A 9/1990 Ross et al.
5,012,863 A 5/1991 Springer
5,013,005 A * 5/1991 Nance ..... E21B 33/062 251/1.3
5,117,909 A 6/1992 Wilton et al.
5,129,956 A 7/1992 Christopher et al.
5,176,208 A 1/1993 Lalande et al.
5,197,547 A 3/1993 Morgan
5,295,541 A 3/1994 Ng et al.
5,330,000 A 7/1994 Givens et al.
5,358,048 A 10/1994 Brooks
5,507,346 A 4/1996 Gano et al.
5,580,114 A 12/1996 Palmer
5,678,635 A 10/1997 Dunlap et al.
5,775,420 A 7/1998 Mitchell et al.
5,833,001 A 11/1998 Song et al.
5,842,518 A 12/1998 Soybel et al.
5,924,489 A 7/1999 Hatcher
5,931,443 A 8/1999 Corte, Sr.
5,944,101 A 8/1999 Hearn
6,138,764 A 10/2000 Scarsdale et al.
6,276,452 B1 8/2001 Davis et al.
6,371,204 B1 4/2002 Singh et al.
6,491,108 B1 12/2002 Slup et al.
6,510,900 B2 * 1/2003 Dallas ..... E21B 19/22 166/384
6,595,289 B2 7/2003 Tumlin et al.
6,688,386 B2 2/2004 Cornelssen
6,768,106 B2 7/2004 Gzara et al.
6,808,023 B2 10/2004 Smith et al.
6,899,178 B2 5/2005 Tubel
7,049,272 B2 5/2006 Sinclair et al.
7,096,950 B2 8/2006 Howlett et al.
7,117,956 B2 10/2006 Grattan
7,188,674 B2 3/2007 McGavern, III et al.
7,188,675 B2 3/2007 Reynolds
7,231,975 B2 6/2007 Lavaure et al.
7,249,633 B2 7/2007 Ravensbergen et al.
7,284,611 B2 10/2007 Reddy et al.
7,389,817 B2 * 6/2008 Almdahl ..... E21B 33/064 166/361
7,398,832 B2 7/2008 Brisco
7,405,182 B2 7/2008 Verrett
7,424,909 B2 9/2008 Roberts et al.
7,488,705 B2 2/2009 Reddy et al.
7,497,260 B2 3/2009 Telfer
7,591,305 B2 9/2009 Brookey et al.
7,600,572 B2 10/2009 Slup et al.
7,712,527 B2 5/2010 Roddy
7,762,323 B2 7/2010 Frazier
7,802,621 B2 9/2010 Richards et al.
7,934,552 B2 5/2011 La Rovere
7,965,175 B2 6/2011 Yamano
8,002,049 B2 8/2011 Keese et al.
8,069,916 B2 12/2011 Giroux
8,453,724 B2 6/2013 Zhou
8,496,055 B2 7/2013 Mootoo et al.
8,579,024 B2 11/2013 Mailand et al.
8,770,276 B1 7/2014 Nish et al.
8,899,338 B2 * 12/2014 Elsayed ..... E21B 33/085 166/385
9,109,433 B2 8/2015 DiFoggio et al.
9,133,671 B2 9/2015 Kellner
9,212,532 B2 12/2015 Leuchtenberg et al.
9,359,861 B2 6/2016 Burgos
9,410,066 B2 8/2016 Ghassemzadeh
9,416,617 B2 8/2016 Wiese et al.
9,574,417 B2 2/2017 Laird et al.
9,657,213 B2 5/2017 Murphy et al.
10,202,817 B2 * 2/2019 Arteaga ..... E21B 33/062
10,280,706 B1 5/2019 Sharp, III
2002/0053428 A1 5/2002 Maples
2003/0047312 A1 3/2003 Bell
2003/0132224 A1 7/2003 Spencer
2005/0167097 A1 8/2005 Sommers et al.
2007/0137528 A1 6/2007 Le Roy-Ddelage et al.
2007/0181304 A1 8/2007 Rankin et al.
2008/0236841 A1 10/2008 Howlett et al.
2008/0251253 A1 10/2008 Lumbye
2009/0194290 A1 8/2009 Parks et al.
2009/0250220 A1 10/2009 Stamoulis
2010/0270018 A1 10/2010 Howlett
2011/0036570 A1 2/2011 La Rovere et al.
2011/0067869 A1 3/2011 Bour et al.
2011/0168411 A1 7/2011 Braddick
2011/0259609 A1 10/2011 Hessels et al.
2011/0278021 A1 11/2011 Travis et al.
2012/0012335 A1 1/2012 White et al.
2012/0118571 A1 5/2012 Zhou
2012/0170406 A1 7/2012 DiFoggio et al.
2013/0240207 A1 9/2013 Frazier
2013/0296199 A1 11/2013 Ghassemzadeh
2016/0237810 A1 8/2016 Beaman et al.
2016/0281458 A1 9/2016 Greenlee
2016/0305215 A1 10/2016 Harris et al.
2017/0044864 A1 2/2017 Sabins et al.
2017/0058628 A1 3/2017 Van Wijk et al.
2017/0067313 A1 3/2017 Connell et al.

(56) References Cited

U.S. PATENT DOCUMENTS

| | | | |
|---|---|---|---|
| 2018/0187498 | A1 | 7/2018 | Soto et al. |
| 2018/0245427 | A1 | 8/2018 | Jimenez et al. |
| 2019/0024473 | A1 | 1/2019 | Arefi |

FOREIGN PATENT DOCUMENTS

| | | |
|---|---|---|
| CA | 2734032 | 6/2016 |
| DK | 2236742 | 8/2017 |
| GB | 2392183 | 2/2004 |
| GB | 2492663 | 1/2013 |
| WO | WO 1989012728 | 12/1989 |
| WO | WO 2002090711 | 11/2002 |
| WO | WO 2010132807 | 11/2010 |
| WO | WO 2012164023 | 12/2012 |
| WO | WO 2019132877 | 7/2019 |

OTHER PUBLICATIONS

Scribd [online], "Milling Practices and Procedures," retrieved from URL <https://www.scribd.com/document/358420338/Milling-Rev-2-Secured>, 80 pages.

Tam International Inflatable and Swellable Packers, "TAM Scab Liner brochure," Tam International, available on or before Nov. 15, 2016, 4 pages.

PCT International Search Report and Written Opinion in International Appln. No. PCT/US2020/059043, dated Jan. 25, 2021, 13 pages.

* cited by examiner

DUAL STRING FLUID MANAGEMENT DEVICES FOR OIL AND GAS APPLICATIONS

TECHNICAL FIELD

This disclosure relates to fluid management devices, such as dual string annular blowout preventers that are designed to seal around two tubular strings disposed simultaneously within a wellbore.

BACKGROUND

During certain operations performed at a wellbore, formation fluid within an annular region that surrounds a pipe of a tubing string disposed within the wellbore may begin to flow uncontrollably in an uphole direction, thereby posing the risk of a blowout of the wellbore. Annular blowout preventers are designed to seal around a single pipe during wellbore control situations in order to contain the pressure of the formation fluid within the wellbore and therefore avoid uncontrolled flow of the formation fluid from the wellbore. However, when two pipes are run simultaneously in parallel in the wellbore, a packing element of an annular blowout preventer cannot reach between the two pipes to provide sealing. In such situations, the safety of a rig at the wellbore will be significantly compromised.

SUMMARY

This disclosure relates to a fluid management device that is designed to seal around two parallel pipes disposed within a wellbore of a rock formation. Sealing of the fluid management device to exterior surfaces of the pipes can prevent formation fluid flowing within an annular region of the wellbore from spewing uncontrollably out of the wellbore.

The fluid management device has a generally annular shape and includes an adjustable seal. The adjustable seal includes multiple flexible segments that are positioned about a circumference of the adjustable seal and that define an opening in which the two pipes are located. The flexible segments include two oppositely located, relatively long rubber elements and two oppositely located, relatively short rubber elements. The adjustable seal can be activated to seal against the pipes and deactivated to relax from the pipes. For example, in an activated state of the adjustable seal, the relatively long rubber elements are shifted radially inward to contact each other in the opening between the two pipes and to seal against adjacent surface areas of the pipes, and the relatively short rubber elements are shifted radially inward to seal against the remaining outer surface area of the pipes. Such sealing to the pipes and connection of the long rubber elements in the opening prevents formation fluid from flowing in an uphole direction within the annular region of the wellbore around the pipes.

The fluid management system also includes a piston providing a wedge-shaped platform along which the adjustable seal can move radially to collapse against the pipes and a housing that contains the piston. The piston can be shifted hydraulically to adjust the adjustable seal supported thereon.

In one aspect, a fluid management device includes a seal and a piston coupled to the seal and movable to an activated position to adjust the seal to an activated state. The seal includes first sealing elements extending radially inward towards a central axis of the fluid management device and second sealing elements extending radially inward towards the central axis, the first and second sealing elements together defining an opening sized to surround first and second pipes disposed within a wellbore containing wellbore fluid. In the activated state of the seal, the first sealing elements contact each other within the opening between the first and second pipes and seal against a first inner portion of the first pipe and a second inner portion of the second pipe to close the opening between the first and second pipes, the second sealing elements seal against a first outer portion of the first pipe and a second outer portion of the second pipe to close the opening around the first and second pipes, and a closed state of the opening prevents the wellbore fluid from exiting the wellbore through the opening.

Embodiments may provide one or more of the following features.

In some embodiments, the piston is further movable to a deactivated position to adjust the seal to a deactivated state in which the first and second sealing elements are radially spaced from the first and second pipes to expose the opening.

In some embodiments, the first and second sealing elements are circumferentially spaced from each other in the deactivated state of the seal.

In some embodiments, the fluid management device further includes a housing that contains the piston.

In some embodiments, the housing and the piston together define an activation chamber that is expandable hydraulically to move the piston in an uphole direction to the activated position.

In some embodiments, the housing and the piston together define a deactivation chamber that is expandable hydraulically to move the piston in a downhole direction to the deactivated position.

In some embodiments, the activation and deactivation chambers are expandable with hydraulic oil.

In some embodiments, the housing defines an annular region that surrounds the first and second pipes below the opening of the seal and that is in fluid communication with the wellbore fluid.

In some embodiments, the seal is configured to seal the annular region in the activated state and to expose the annular region in the deactivated state.

In some embodiments, the first sealing elements are radially longer than the second sealing elements.

In some embodiments, the first and second sealing elements are made of rubber.

In some embodiments, the piston includes first surfaces along which the first sealing elements can move radially inward to achieve the activated state and radially outward to achieve the deactivated state.

In some embodiments, the piston further includes a second surface along which the second sealing elements can move radially inward to achieve the activated state and radially outward to achieve the deactivated state.

In some embodiments, the first surfaces are oriented at a first acute angle with respect to the central axis, and the second surface is oriented at a second acute angle with respect to the central axis.

In some embodiments, the first angle is larger than the second angle.

In some embodiments, the fluid management system further includes a closing element that supports the seal atop the piston.

In another aspect, a method of sealing an annular region surrounding first and second pipes disposed within a wellbore containing wellbore fluid includes providing a seal of a fluid management device, the seal including first sealing elements extending radially inward towards a central axis of the fluid management device and second sealing elements extending radially inward towards the central axis, the first and second sealing elements together defining an opening sized to surround first and second pipes disposed within the wellbore. The method further includes moving a piston of the fluid management device that is coupled to the seal to an activated position and adjusting the seal, coupled to the piston, to an activated state in which the first sealing elements contact each other within the opening between the first and second pipes and seal against a first inner portion of the first pipe and a second inner portion of the second pipe to close the opening between the first and second pipes, the second sealing elements seal against a first outer portion of the first pipe and a second outer portion of the second pipe to close the opening around the first and second pipes, and a closed state of the opening prevents the wellbore fluid from exiting the wellbore through the opening.

Embodiments may provide one or more of the following features.

In some embodiments, the method further includes moving the piston to a deactivated position and adjusting the seal, coupled to the piston, to a deactivated state in which the first and second sealing elements are radially spaced from the first and second pipes to expose the opening.

In some embodiments, the first sealing elements are radially longer than the second sealing elements.

In some embodiments, adjusting the seal to the activated state includes moving the first sealing elements radially inward toward the first and second pipes at a first speed and moving the second sealing elements radially inward toward the first and second pipes at a second speed that is less than the first speed.

The details of one or more embodiments are set forth in the accompanying drawings and description. Other features, aspects, and advantages of the embodiments will become apparent from the description, drawings, and claims.

DETAILED DESCRIPTION

Figures 1, 2:
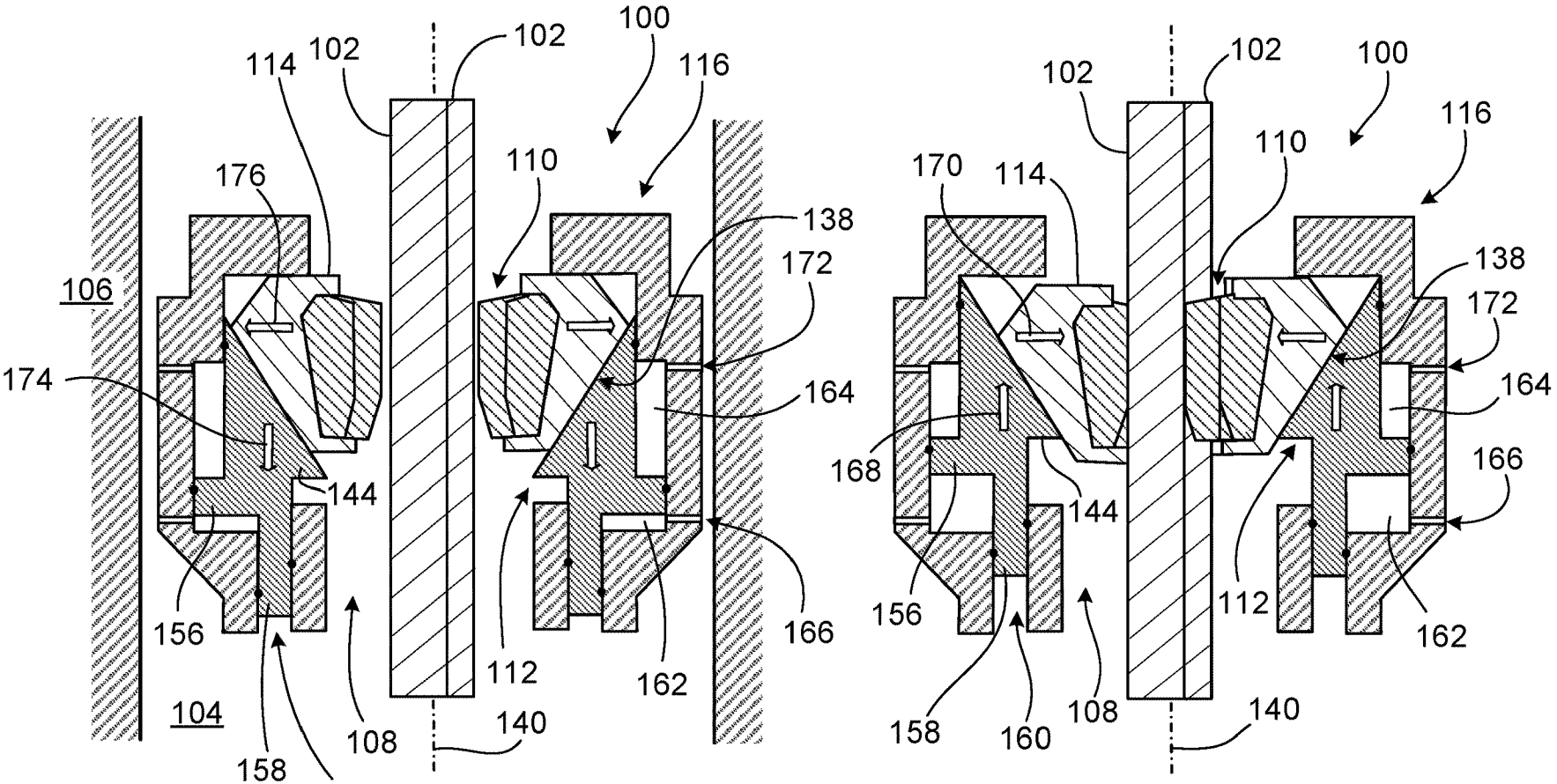
FIG. 1 is a side cross-sectional view of an example fluid management device in a deactivated state.
FIG. 2 is a side cross-sectional view of the fluid management device of FIG. 1 in an activated state.

FIG. 1 illustrates a fluid management device 100 that is designed to seal around two pipes 102 disposed simultaneously within a wellbore 104 of a rock formation 106 during drilling or workover operations at the wellbore 104. That is, the fluid management device 100 may be embodied as a dual string annular blowout preventer. The pipes 102 may be positioned laterally adjacent to each other and substantially parallel to each other within the wellbore 104 to form part of a dual string tubing configuration. Accordingly, the pipes 102 are segments of respective tubular strings disposed within the wellbore 104. In some instances, formation fluid within an annular region 108 that surrounds the pipes 102 within the wellbore 104 may begin to flow uncontrollably in an uphole direction 168, thereby posing the risk of a blowout of the wellbore 104. The fluid management device 100 is designed to seal against exterior surfaces of the pipes 102 to prevent formation fluid that is flowing within the annular region 108 from spewing uncontrollably out of the wellbore 104 in such instances. In this manner, the fluid management device 100 is designed to isolate a pressure of the formation fluid within the annular region 108.

Figure 3:
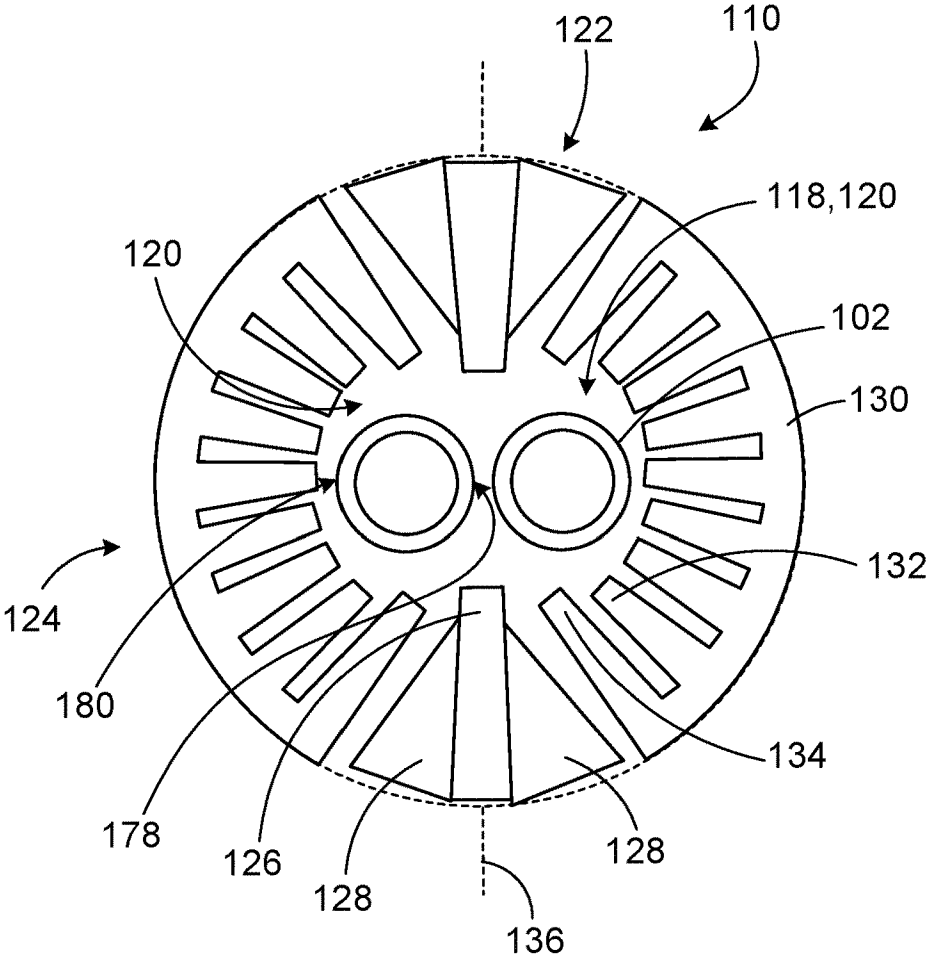
FIG. 3 is a top view of an adjustable seal of the fluid management device of FIG. 1 in the deactivated state.

The fluid management device 100 has a generally annular cross-sectional shape and includes an adjustable seal 110 that can move radially inward to collapse against the pipes 102, a piston 112 that is movable to activate the adjustable seal 110, a closing element 114 that supports the adjustable seal 110 atop the piston 112, and a housing 116 that contains the piston 112. Referring to FIG. 3, the adjustable seal 110 is symmetric with respect to a center line 136 of the fluid management system 100. The adjustable seal 110 includes multiple circumferential, flexible segments that together define an opening 118 in which the two pipes 102 are located. The opening 118 has a generally ovular shape and includes two regions 120 that are located on opposite sides of the center line 136. The two regions 120 of the opening 118 respectively surround the two pipes 102.

With respect to radial length, the flexible segments include two relatively long segments 122 that are located at opposite sides of a central axis 140 of the fluid management system 100 and two relatively short segments 124 that are located at opposite, orthogonal sides of the central axis 140. Each long segment 122 includes an elongate protrusion 126 and two generally triangular base components 128 that taper towards the elongate protrusion 126. Each short segment 124 includes a circumferential base component 130, multiple inner protrusions 132, and two outer protrusions 134 that flank the inner protrusions 132. The elongate protrusions 126 of the long segments 122 are radially longer than the outer protrusions 134 of the short segments 134, while the outer protrusions 134 are radially longer than the inner protrusions 132 of the short segments 134.

Figure 4:
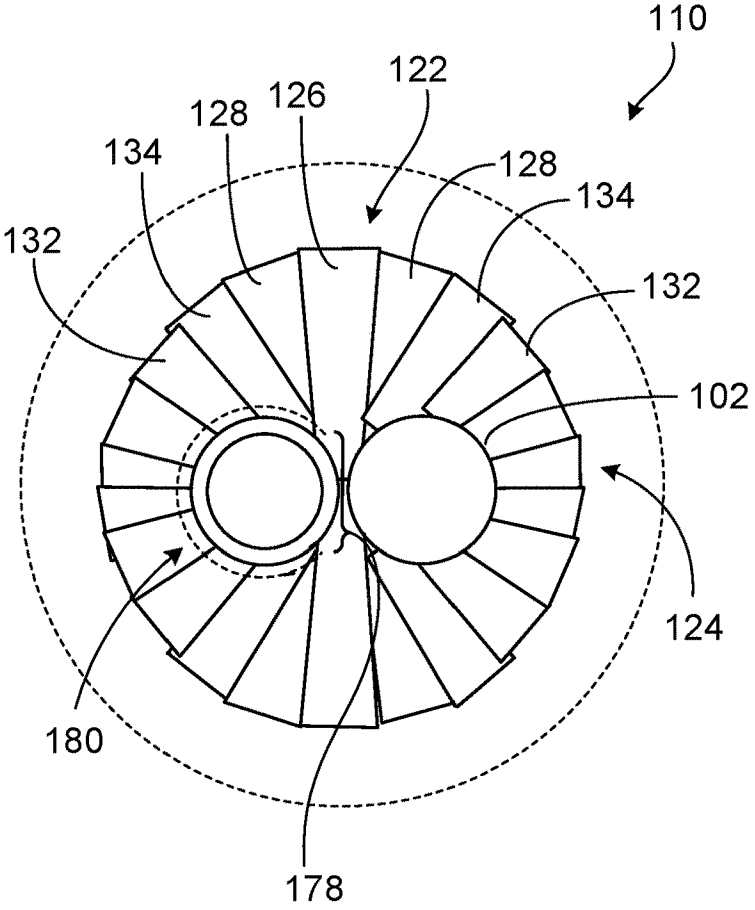
FIG. 4 is a top view of the adjustable seal of FIG. 3 in the activated state.

In FIGS. 1 and 3, the adjustable seal 110 is illustrated in a deactivated state in which the long and short segments 122, 124 are relaxed (for example, spaced apart) from the pipes 102 such that the annular region 108 is exposed and accessible. Referring to FIGS. 2 and 4, the adjustable seal 110 can be activated to seal against the pipes 102 and to thereby seal the annular region 108 and contain the pressure of formation fluid within the annular region 108. For example, in an activated state of the adjustable seal 110, the long segments 122 are shifted radially inward such that the elongate protrusions 126 contact (for example, compress) each other in the opening 118 between the two pipes 102 and seal against adjacent inner surface areas 178 of the pipes 102. The short segments 124 are also shifted radially inward such that the inner and outer protrusions 132, 134 seal against outer surface areas 180 of the pipes 102. Such sealing to the pipes 102 and connection of the elongate protrusions 126 within the opening 118 prevents formation fluid within the annular region 108 from flowing out of the wellbore 104 in the uphole direction 168 between and around the pipes 102.

The adjustable seal 110 is typically made of rubber. Referring to FIG. 3, the adjustable seal 110 typically has an outer diameter of about 1.0 meters (m) to about 1.5 m in the deactivated state. Referring to FIGS. 1 and 2, the adjustable seal 110 typically has a height of about 0.5 m to about 0.75 m. Referring to FIG. 3, the opening 118 typically has a length (for example, measured between opposite inner protrusions 132) of about 0.34 m to about 0.76 m and a width (for example, measured between opposite elongate protrusions 126) of about 0.30 m to about 0.71 m in the deactivated state. Each pipe 102 typically has a diameter in a range of about 0.06 m to about 0.09 m. Referring to FIG. 4, and in the case of pipes 102 with an outer diameter of about 0.06 m, the adjustable seal 110 typically has an outer diameter of about 0.88 m to about 1.3 m in the activated state. In some embodiments, the elongate protrusions 126 have a radial length of about 0.30 m to about 0.35 m, the outer protrusions 134 have a length of about 0.25 m to about 0.30 m, and the inner protrusions 132 have a length of about 0.20 m to about 0.25 m. The various dimensions stated herein will generally depend on a size and a pressure rating of the fluid management device 100.

Referring to FIGS. 1 and 2, the adjustable seal 110 is supported by the closing element 114. The closing element 114 is formed as a set of metallic inserts that together extend around a complete circumference of the fluid management device, as does the adjustable seal 110. The metallic inserts have respective sizes and shapes that correspond to the sizes and shapes of the long and short segments 122, 124 of the adjustable seal 110. The closing element 114 is typically made of steel. An inner profile of the closing element 114 has a shape that is complementary to a shape of an outer profile of the adjustable seal 110. The closing element 114 also has an outer surface 138 that is inclined to interface with the piston 112. Referring to FIGS. 1, 2, 5, and 6, the piston 112 includes a main body 154 that is symmetric with respect to the center line 136. The main body 154 defines a wedge-shaped platform 144 that provides an inclined surface 146 that supports a portion of the closing element 114. In particular, the platform 144 supports a portion of the closing element 114 that supports the short segments 124 of the adjustable seal 110.

Figure 5:
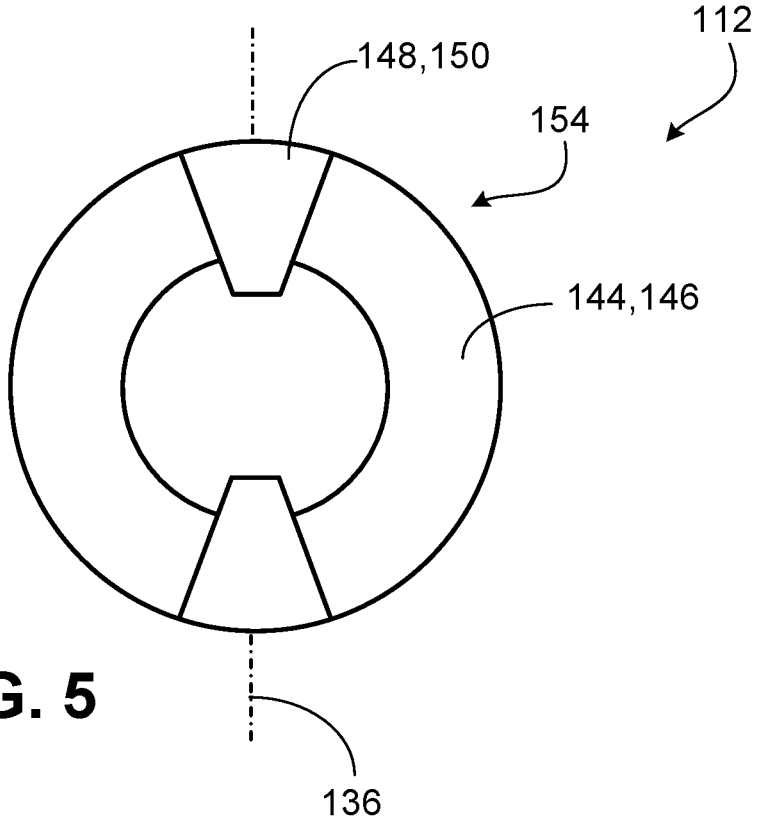
FIG. 5 is a top view of a piston of the fluid management device of FIG. 1.
Figure 6:
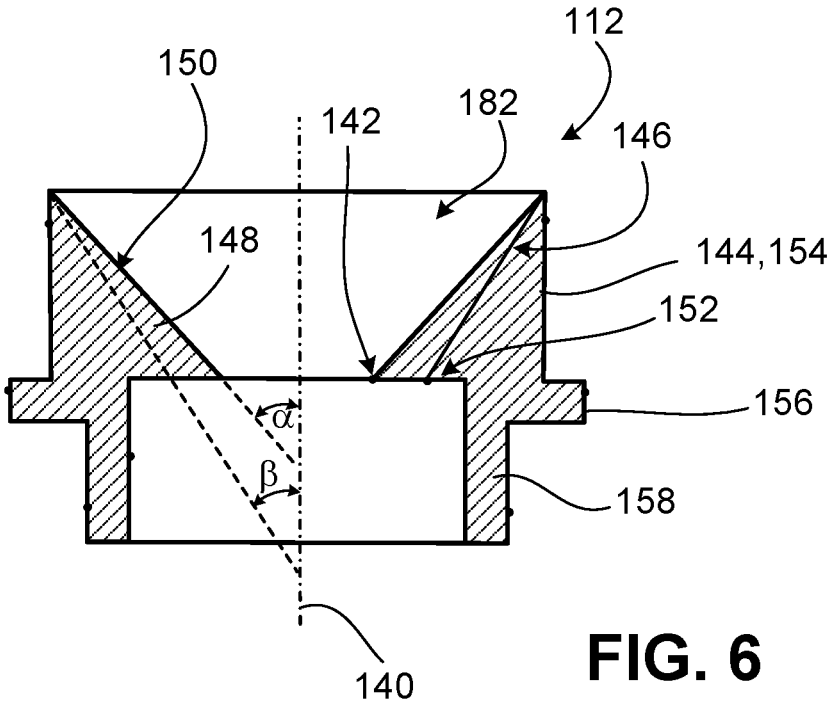
FIG. 6 is a side cross-sectional view of the piston of FIG. 5.

Referring particularly to FIGS. 5 and 6, the piston 112 also includes two opposite, shorter platforms 148 that are positioned atop the main body 154 along the centerline 136 and formed to support a portion of the closing element 114 that supports the long segments 122 of the adjustable seal 110. The platforms 148 provide inclined surfaces 150 that are oriented at a shallower angle than is the inclined surface 146 of the platform 144. The inclined surfaces 150 therefore terminate at radial positions 142 that are closer to the central axis 140 than is a radial position 152 at which the inclined surface 146 terminates. The shallower angle of the inclined surfaces 150 cause the long segments 122 to shift radially inward at a speed faster than a speed at which the short segments 124 shift radially inward. The increased speed allows the elongate protrusions 126 to contact each other (as shown in FIG. 4) within the opening 118 of the adjustable seal 110 before the short segments 124 would otherwise abut the pipes 102 and thereby stop any further radially inward movement of the adjustable seal 110 that would prevent the elongate protrusions 126 from reaching each other within the opening 118.

Referring particularly to FIG. 6, the piston 112 defines a frustoconical shaped activation region 182 in which the closing element 114 and the adjustable seal 110 are disposed. The inclined surface 150 is typically oriented at an acute angle $\alpha$ of about 40 degrees to about 50 degrees with respect to the central axis 140, whereas the inclined surface 146 is typically oriented at an acute angle $\beta$ of about 30 degrees to about 40 degrees with respect to the central axis 140. The piston 112 is typically made of steel.

Referring particularly to FIGS. 1 and 2, the body 154 further defines a horizontal protrusion 156 and a vertical protrusion 158 that extend from the platform 144 and position the piston 112 within the housing 116. The protrusions 156, 158 extend about a complete circumference of the piston 112, as does the platform 144. The housing 116 defines a lower circumferential channel 160 that receives the vertical protrusion 158 of the piston 112. The housing 116 and the piston 112 together define a dynamic activation chamber 162 and a dynamic deactivation chamber 164.

The housing 116 further defines an activation port 166 at which an activation fluid (for example, hydraulic oil) can be injected into the activation chamber 162 to force the piston 112 in the uphole direction 168 from a deactivated position (as shown in FIG. 1) to an activated position (as shown in FIG. 2). Moving the piston 112 in the uphole direction 168 expands a volume of the activation chamber 162 and causes the closing element 114, and the adjustable seal 110 supported thereon, to move in a radially inward direction 170 to collapse the adjustable seal 110 onto the pipes 102 to seal the annular region 108. Such movement of the closing element 114 accordingly reduces a volume of the deactivation chamber 164. Once the adjustable seal 110 has been activated to seal the annular region 108, the activation port 166 is closed to maintain the activated state for a desired period of time. The adjustable seal 110 is typically maintained in the activated state for a period of about 1 or more hours, as needed.

The housing 116 also defines a deactivation port 172 that contains deactivation fluid (for example, hydraulic oil). The deactivation port 172 is open during injection of the activation fluid at the activation port 166 to allow an appropriate amount of the deactivation fluid to exit the deactivation chamber 164. For example, a volume of deactivation fluid that flows out of the deactivation chamber 164 will be substantially equal to a volume of activation fluid that is injected into the activation chamber 162 at the activation port 166. Once the adjustable seal 110 has been activated, then the deactivation port 172 is closed and maintained in a closed state for as long as the adjustable seal 110 is activated.

In order to deactivate the adjustable seal 110 (as shown in FIGS. 1 and 2), the activation and deactivation ports 166, 172 are opened, and deactivation fluid is injected into the deactivation chamber 164 at the deactivation port 172 to force the piston 112 in a downhole direction 174 from the activated position (as shown in FIG. 2) to the deactivated position (as shown in FIG. 1). Moving the piston 112 in the downhole direction 174 expands the volume of the deactivation chamber 164 and causes the closing element 114, and the adjustable seal 110 supported thereon, to move in a radially outward direction 176 to release the adjustable seal 110 from the pipes 102 to expose the annular region 108 at the opening 118. Such movement of the closing element 114 accordingly reduces a volume of the activation chamber 162. For example, a volume of activation fluid that flows out of the activation chamber 162 at the activation port 166 during such movement is about equal to a volume of deactivation fluid that is injected into the deactivation port 172. Once the adjustable seal 110 has been deactivated, then both of the activation and deactivation ports 166, 172 are closed and maintained in a closed state for as long as the adjustable seal 110 is deactivated.

Figure 7:
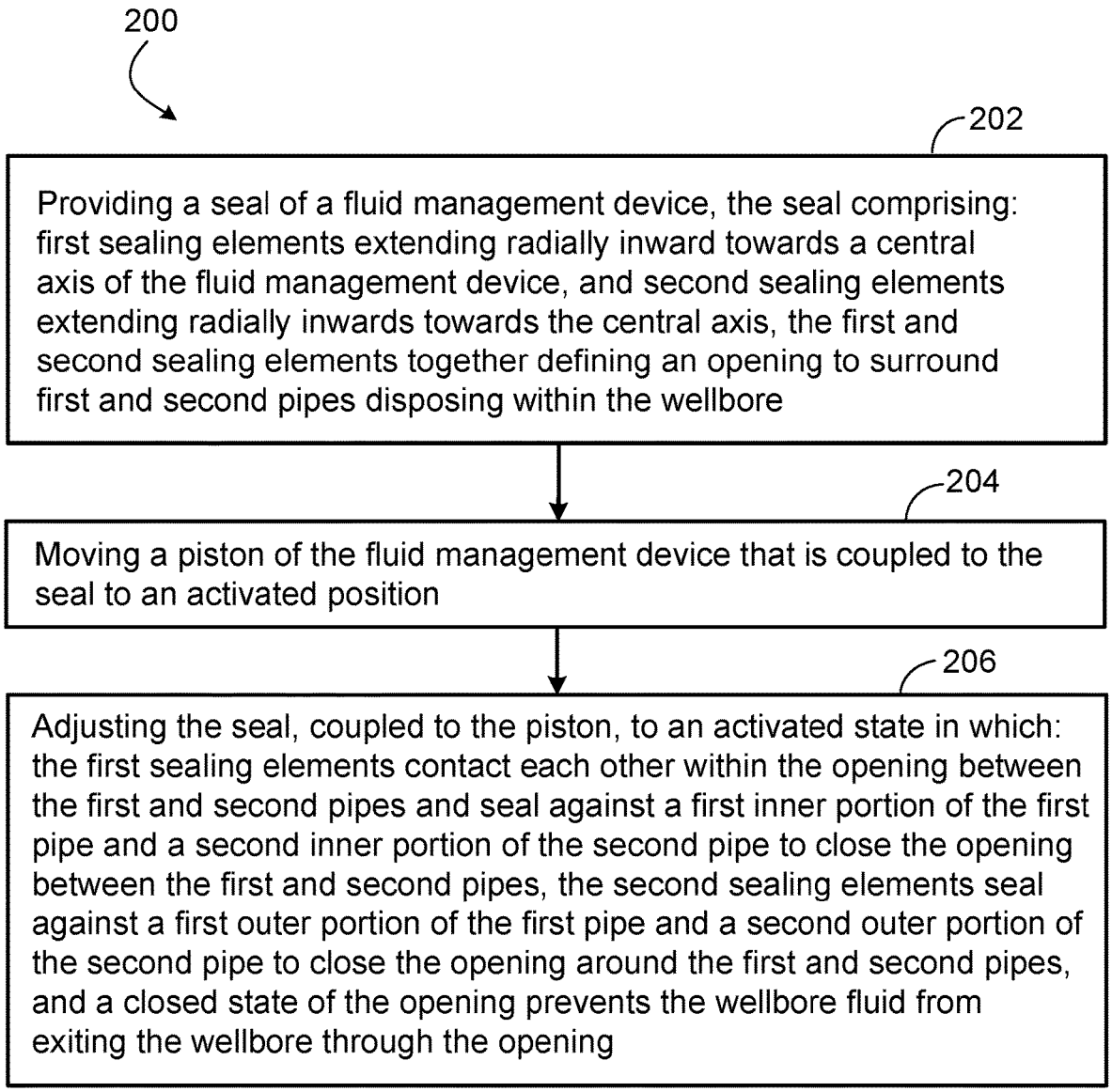
FIG. 7 is a flow chart illustrating an example method of sealing an annular region surrounding first and second pipes disposed within a wellbore containing wellbore fluid using the fluid management device of FIG. 1.

FIG. 7 is a flow chart illustrating an example method 200 of sealing an annular region (for example, the annular region 108) surrounding first and second pipes (for example, the pipes 102) disposed within a wellbore (for example, the wellbore 104) containing wellbore fluid. In some embodiments, the method 200 includes providing a seal (for example, the adjustable seal 110) of a fluid management device (for example, the fluid management device 100) (202). The seal includes first sealing elements (for example, the long segments 122) extending radially inward towards a central axis (for example, the central axis 140) of the fluid management device and second sealing elements (for example, the short segments 124) extending radially inward towards the central axis, the first and second sealing elements together defining an opening (for example, the opening 118) sized to surround first and second pipes disposed within the wellbore.

In some embodiments, the method 200 further includes moving a piston (for example, the piston 112) of the fluid management device that is coupled to the seal to an activated position (204). In some embodiments, the method further includes adjusting the seal, coupled to the piston, to an activated state (206). In the activated state, the first sealing elements contact each other within the opening between the first and second pipes and seal against a first inner portion of the first pipe and a second inner portion of the second pipe (for example, the inner surface areas 178) to close the opening between the first and second pipes. In the activated state, the second sealing elements also seal against a first outer portion of the first pipe and a second outer portion of the second pipe (for example, the outer surface areas 180) to close the opening around the first and second pipes. In the activated state, a closed state of the opening prevents the wellbore fluid from exiting the wellbore through the opening.

While the fluid management device 100 has been described and illustrated with respect to certain dimensions, sizes, shapes, arrangements, materials, and methods 200, in some embodiments, a fluid management device that is otherwise substantially similar in construction and function to the fluid management device 100 may include one or more different dimensions, sizes, shapes, arrangements, and materials or may be utilized according to different methods.

Accordingly, other embodiments are also within the scope of the following claims.

What is claimed is:

1. A fluid management device, comprising:

a seal comprising:

first sealing elements extending radially inward towards a central axis of the fluid management device, and second sealing elements extending radially inward towards the central axis, the first and second sealing elements together defining an opening sized to surround first and second pipes disposed within a wellbore containing wellbore fluid; and a piston coupled to the seal and movable to an activated position to adjust the seal to an activated state in which:

the first sealing elements contact each other within the opening between the first and second pipes and seal against a first inner portion of the first pipe and a second inner portion of the second pipe to close the opening between the first and second pipes, the second sealing elements seal against a first outer portion of the first pipe and a second outer portion of the second pipe to close the opening around the first and second pipes, and a closed state of the opening prevents the wellbore fluid from exiting the wellbore through the opening, wherein the piston comprises first surfaces along which the first sealing elements can move radially inward to achieve the activated state and radially outward to achieve a deactivated state;

wherein the piston is further movable to a deactivated position to adjust the seal to the deactivated state in which the first and second sealing elements are radially spaced from the first and second pipes to expose the opening;

a housing that contains the piston;

wherein the housing defines an annular region that surrounds the first and second pipes below the opening of the seal and that is in fluid communication with the wellbore fluid.

2. The fluid management device of claim 1, wherein the first and second sealing elements are circumferentially spaced from each other in the deactivated state of the seal.

3. The fluid management system of claim 1, wherein the housing and the piston together define an activation chamber that is expandable hydraulically to move the piston in an uphole direction to the activated position.

4. The fluid management system of claim 3, wherein the housing and the piston together define a deactivation chamber that is expandable hydraulically to move the piston in a downhole direction to the deactivated position.

5. The fluid management system of claim 4, wherein the activation and deactivation chambers are expandable with hydraulic oil.

6. The fluid management system of claim 1, wherein the seal is configured to seal the annular region in the activated state and to expose the annular region in the deactivated state.

7. The fluid management device of claim 1, wherein the first sealing elements are radially longer than the second sealing elements.

8. The fluid management device of claim 1, wherein the first and second sealing elements comprise rubber.

9. The fluid management device of claim 1, wherein the piston further comprises a second surface along which the second sealing elements can move radially inward to achieve the activated state and radially outward to achieve the deactivated state.

10. The fluid management system of claim 9, wherein the first surfaces are oriented at a first acute angle with respect to the central axis, and wherein the second surface is oriented at a second acute angle with respect to the central axis.

11. The fluid management system of claim 10, wherein the first angle is larger than the second angle.

12. The fluid management system of claim 1, further comprising a closing element that supports the seal atop the piston.

13. A method of sealing an annular region surrounding first and second pipes disposed within a wellbore containing wellbore fluid, the method comprising:

providing a seal of a fluid management device, the seal comprising:

first sealing elements extending radially inward towards a central axis of the fluid management device, and second sealing elements extending radially inward towards the central axis, the first and second sealing elements together defining an opening sized to surround first and second pipes disposed within the wellbore, wherein the first sealing elements are radially longer than the second sealing elements; and moving a piston of the fluid management device that is coupled to the seal to an activated position;

adjusting the seal, coupled to the piston, to an activated state in which:

the first sealing elements contact each other within the opening between the first and second pipes and seal against a first inner portion of the first pipe and a second inner portion of the second pipe to close the opening between the first and second pipes, the second sealing elements seal against a first outer portion of the first pipe and a second outer portion of the second pipe to close the opening around the first and second pipes, and a closed state of the opening prevents the wellbore fluid from exiting the wellbore through the opening, wherein adjusting the seal to the activated state comprises:

moving the first sealing elements radially inward toward the first and second pipes at a first speed, and moving the second sealing elements radially inward toward the first and second pipes at a second speed that is less than the first speed.

14. The method of claim 13, further comprising:

moving the piston to a deactivated position; and adjusting the seal, coupled to the piston, to a deactivated state in which the first and second sealing elements are radially spaced from the first and second pipes to expose the opening.

* * * * *